US007703937B2

(12) United States Patent
Shirey

(10) Patent No.: US 7,703,937 B2
(45) Date of Patent: Apr. 27, 2010

(54) HANDS FREE LIGHT EMITTING DIODE (LED) ILLUMINATION DEVICE

(76) Inventor: Carey O'Brien Shirey, 867 Burgess Smith Rd., Sadieville, KY (US) 40370

( * ) Notice: Subject to any disclaimer, the term of this patent is extended or adjusted under 35 U.S.C. 154(b) by 14 days.

(21) Appl. No.: 11/317,166

(22) Filed: Dec. 23, 2005

(65) Prior Publication Data

US 2007/0147025 A1 Jun. 28, 2007

(51) Int. Cl.
*F21L 4/00* (2006.01)

(52) U.S. Cl. ..... 362/103; 362/253; 362/183

(58) Field of Classification Search ..... 362/103, 362/183, 104, 109, 253
See application file for complete search history.

(56) References Cited

U.S. PATENT DOCUMENTS

| | | | | |
|---|---|---|---|---|
| 3,735,120 | A * | 5/1973 | Flider | 362/160 |
| 5,124,892 | A * | 6/1992 | Lambert | 362/103 |
| H1154 | H * | 3/1993 | Gibson et al. | 359/501 |
| 6,179,431 | B1 * | 1/2001 | Chien | 362/84 |
| 6,577,073 | B2 * | 6/2003 | Shimizu et al. | 315/246 |
| 6,732,469 | B2 * | 5/2004 | Lindgren | 43/17.5 |
| 6,802,621 | B2 * | 10/2004 | Adeler | 362/157 |
| 6,894,434 | B1 * | 5/2005 | Kosoff | 315/134 |
| 7,097,323 | B2 * | 8/2006 | Puckett | 362/202 |
| 7,165,859 | B1 * | 1/2007 | Munari | 362/103 |
| 2003/0206393 | A1 * | 11/2003 | Murray, Jr. | 361/679 |

FOREIGN PATENT DOCUMENTS

DE 4433623 A1 * 10/1995

* cited by examiner

*Primary Examiner*—Sharon E Payne
(74) *Attorney, Agent, or Firm*—Francis Law Office, PLLC; James M. Francis

(57) ABSTRACT

A reading light ring including a battery powered LED as the source of illumination. The reading light ring is intended to be worn on the index finger and operated by means of a thumb operated switch located on the side of the ring. The light emitted by the LED is preferably blue to green in wavelength so as to improve visual acuity in low light environments while minimizing the impact on the human eye readjusting from lighted to dark conditions. The LED is positioned so as to direct most of its light at an angle which would allow the illumination of a document held in the device bearing hand and allow the LED to be shielded by the opposing hand. The device is preferably waterproof and shock resistant.

17 Claims, 5 Drawing Sheets

FIG. 9
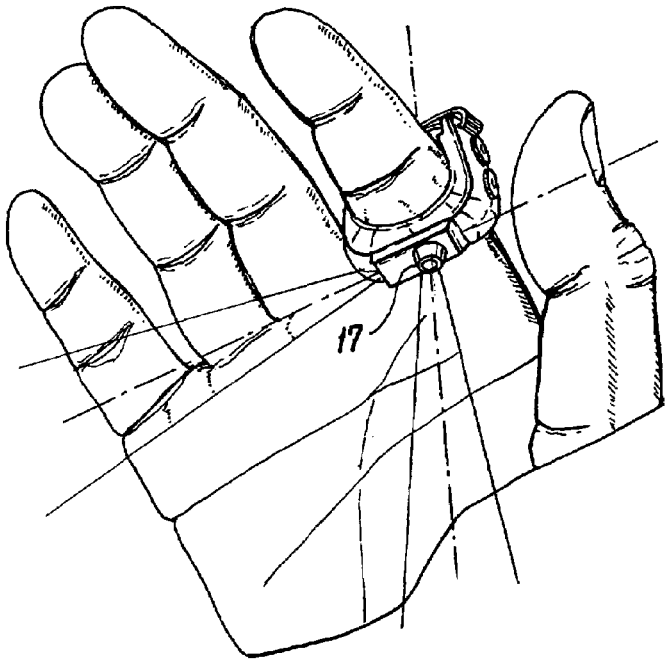
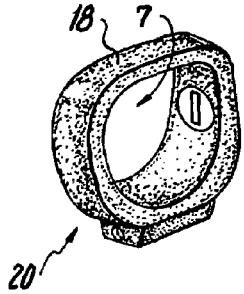
FIG. 10
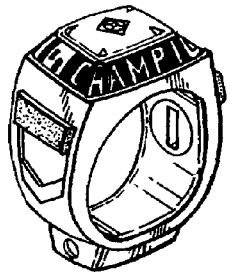
FIG. 11
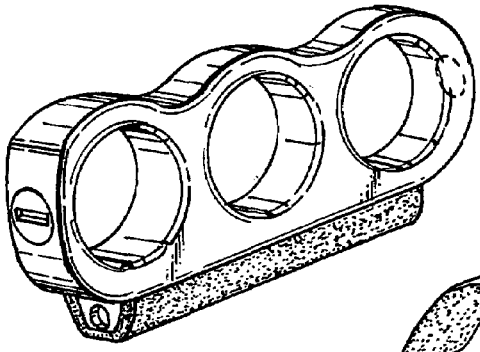
FIG. 12
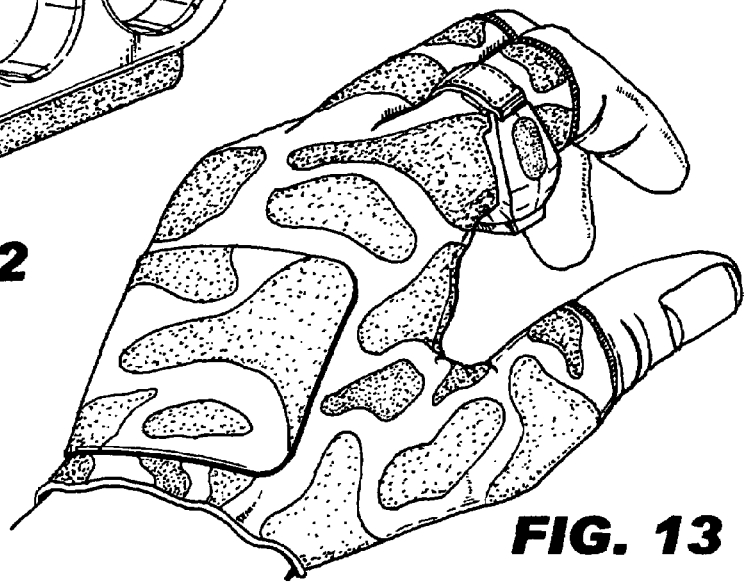
FIG. 13

HANDS FREE LIGHT EMITTING DIODE (LED) ILLUMINATION DEVICE

BACKGROUND OF THE INVENTION

1. Field of the Invention

This invention relates to portable illuminating devices, particularly to hands-free illuminating devices worn on the hand. More particularly to hands-free LED sources of illumination worn on the hand.

2. Problems in the Art

Small, portable reading lights have been a part of the field for a considerable length of time. The problem with these devices is that most must be held, thus occupying one hand and leaving the other hand to hold and steady the reading material. This can be clumsy and awkward for the person using the device. Situations exist where the user doesn't have the luxury of fumbling with an illuminating device. Pilots and military personnel can ill afford to make mistakes and become distracted from their task at hand. Additionally, there exists a need for illumination that is bright enough for the task of reading documents such as maps while not being so bright as to cause a dangerous degradation in visual acuity while the user's eyes readjust when the light is turned off. Also, there exists a need for a wearable illuminating device that can be shielded so as to minimize light that escapes in unneeded directions and can reveal the position of the wearer. Several attempts at flashlights integrated with rings are described in the patent literature.

An early attempt at combining a flashlight and ring is described in U.S. Pat. No. 2,516,180, FINGER RING WITH FLASHLIGHT ATTACHMENT by Brown (May 27, 1948), which describes a ring with finger switch operated flashlight attachment. The Brown invention is markedly different from the present invention in that the lamp is much larger, the power source was a rather large, exposed battery that was flimsily attached, and used a large incandescent bulb.

A significant advancement in the art is described in U.S. Pat. No. 4,012,629, FLASHLIGHT RING by Simms (Mar. 15, 1977), which describes a ring with an integrated lamp socket and bulb and arcuate batteries that were contained within the circumference of the ring. The Simms invention is markedly different from the present invention because of the use of a bulb instead of a light-emitting diode (LED) and the location of a protruding button-like switch on the bottom of the ring instead of the use of a sunken pressure sensitive switch on the thumb side of the ring. The Simms invention is also an assembly of pieces along the circumference of the ring that forms the finger orifice while the present invention is preferably of unitary construction.

Japanese Patent 06187802, RING-SHAPED PORTABLE FLASHLIGHT by Yoshisada (Jul. 8, 1994) describes a flashlight formed within a ring shape. However, the Yoshisada patent does not disclose the use of led lights or the use of a thumb switch for one-handed operation. The Yoshisada invention requires the opposing hand to turn the top of the ring 180 degrees to actuate the power switch.

SUMMARY OF THE INVENTION

The need for portable, hands-free LED lighting has been long felt by pilots and military personnel. The present invention provides an illuminating device integrated with a ring. The illuminating part is located palm-side to facilitate the reading of material held by the wearer's hands or to assist in guiding the wearer's hands in the function of tasks in low to no light conditions. Another advantage to the palm-side LED is that the light can be easily concealed while being used.

An LED provides the source of light for the device. The LED is sited at the thumb side of the device at a corner of the ring base, adjacent to the battery compartment, so that the light generated by the LED is cast palm-side and at an angle toward the wearer's mid-line which will illuminate a document being held by the device bearing hand. The LED may optionally be sited at the corner of the base beneath the thumb operated switch.

The advantage of the angled palm-side LED would be to allow the user to direct the light to a somewhat narrow point by making a fist that is open at the bottom thus shielding the light source and preventing a location revealing amount of light from being released, ideal for covert operations. The opposing hand could also be used to further shield the light.

The power source is preferably, but not required to be, a lithium battery which is stored within a battery compartment at the base of the device. The battery compartment cover is slotted so as to allow access by rotating the cover with a key or coin. The battery may of a type that is rechargeable and the device is anticipated to accommodate means to charge the battery without its removal from the device.

A preferred means of operating the device is through a switch located on the ring. More preferably, the means of operating the device is a thumb operated power switch embedded in the side of the device. The switch, as well as the device, is preferably water proof. A control mechanism for adjusting the intensity of the illumination may be integrated into the ring. Preferably, the power switch will also function to adjust the intensity of the provided illumination and a separate control mechanism will not be necessary. It is anticipated that the user could simply actuate the power switch by depressing it with the either the thumb or by squeezing the ring bearing finger and the adjacent finger on the switch side of the ring together. The intensity of the illumination provided by the ring can be adjusted by control mechanisms known to those skilled in the art.

Preferably the illumination intensity is varied through a cycle of varying intensities by the amount of pressure applied to the power switch or control mechanism. An alternative control mechanism would allow the user to cycle through power and intensity settings by clicking the control mechanism through a series of preset switch settings. A further alternative embodiment would allow for the control of the illumination intensity by cycling the intensity from low to high or vice versa during the period of time the control mechanism is actively engaged by the user and is set upon disengagement of the control mechanism. A further actuation would deactivate the device and reset the intensity settings. In yet another embodiment, the illumination intensity is varied by the number of LED's that are actuated by cycling through the illumination settings of the ring.

In a further alternative embodiment, the device can be coated by a rubber-like material to improve water and weather resistance. In a yet further embodiment the LED light can be blue or green to minimize the impact on the eye when turned on or off in the dark. A version for pilots could utilize a red LED. Other LED colors are possible depending on the desired application.

The present invention is preferably durable and shock-resistant. It may be designed to be aesthetically pleasing to disguise its true nature. It may be manufactured from metal, wood, or synthetic materials. A rubberized coating may also be added to inhibit damage as well as improved weather and water resistance.

In yet another embodiment, the ring is a partial annular shape with an adjustable strap means for adjusting the size of the device to fit multiple users and to even fit over a glove.

A further embodiment would incorporate a flip or slide switch at the base of the ring beside the battery which would power the LED on and off and could optionally increment the intensity of the LED.

BRIEF DESCRIPTION OF THE DRAWINGS

FIG. 9 depicts the base of the ring as worn. It further details a further embodiment of a two button control mechanism.

FIG. 10 depicts an embodiment of the device with a solid body encasing the finger orifice instead of an adjustable strap.

FIG. 11 depicts an ornamental alternative embodiment of the device.

FIG. 12 depicts the device integrated into "brass knuckles".

FIG. 13 depicts the device integrated into a glove.

DETAILED DESCRIPTION OF THE INVENTION

Figure 1:
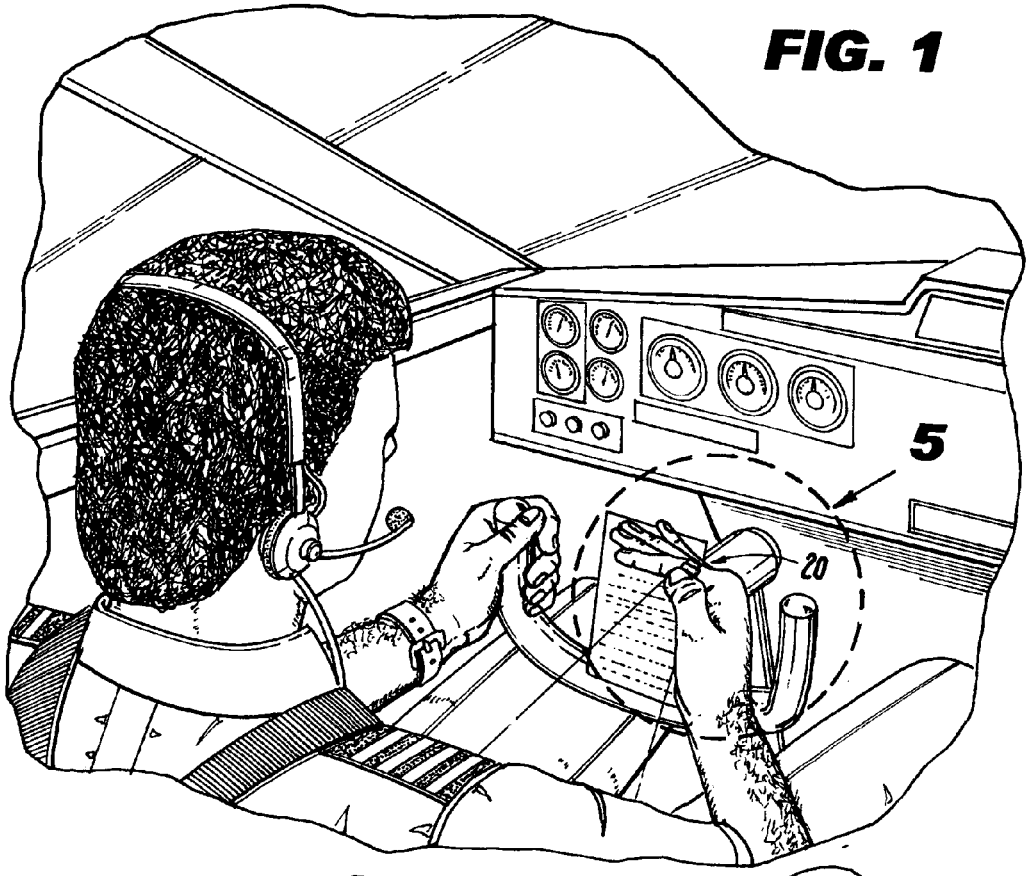
FIG. 1 is a perspective view of the present invention utilized for nighttime illumination in the cockpit of an airplane.

Referring to FIGS. 1 through 15, the ring shaped embodiment of the device of the present invention is generally indicated by the numeral 20. The ring 20 has a palm-side base 8 which houses the battery compartment 10, battery 6, battery compartment cover 3, and LED 1.

Referring to FIG. 1, an anticipated use would be as a visual aid to pilots flying in low light conditions wherein a bright light with which to read can cause difficulty in refocusing the pilot's eyes and can create a safety hazard.

Figure 2:
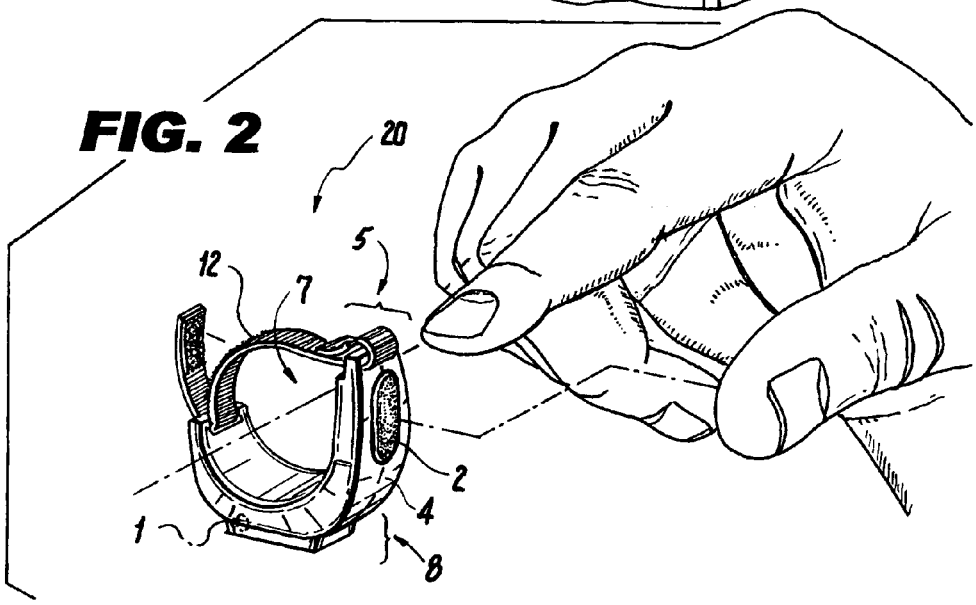
FIG. 2 depicts the placement of the device on the ring finger of the wearer. The device in the present figure utilizes an adjustable strap to allow the device to be worn on fingers of various sizes and also features a thumb side control switch as opposed to the finger side activation switch.

Referring to FIG. 2, an embedded and hidden pressure sensitive control switch is enclosed within the switch housing 2 located on or within the outer surface 4 of the ring 20 on the opposing side of the battery compartment 10. The LED 1 is typically sited on the on the palm side base 8 of the device 20 between the battery compartment 10 and thumb side 5 of the device 20. The LED 1 may optionally be sited elsewhere on the ring, but is especially useful on the palm side base 8.

The LED is contained within the LED housing 11 and may protrude from the LED housing 11, typically at an edge of the LED housing 11 so that it focuses the beam away from the palm of the wearer and angled slightly towards the thumb. It is anticipated that more than one LED 1 can be utilized. The inner surface 6 of the ring forms a finger orifice 7 through which a finger may be inserted and allows the ring 20 to be worn by the user. An adjustable strap 12 passes through two strap slots 13 and permits the device 20 to be worn on different fingers or worn by different wearers. The adjustable strap 12 is anticipated to be secured by Velcro®, but it could be buckled, clamped, or tied down. It is anticipated that more than one LED 1 can be utilized. It is further anticipated that LED's 1 that emit different wavelengths of visible light can be coupled together on the device with means to select which LED 1 is activated. It is also anticipated that light filters could be used to customize the color of visible light emitted from the device.

Figure 3:
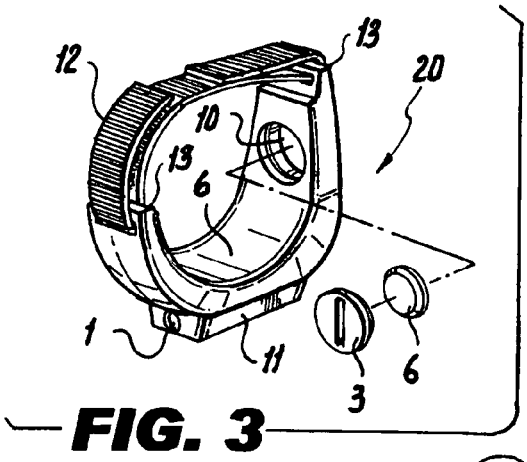
FIG. 3 is an exploded perspective view of the device demonstrating the placement of the battery in the batter compartment as well as the slotted cover.
Figure 4:
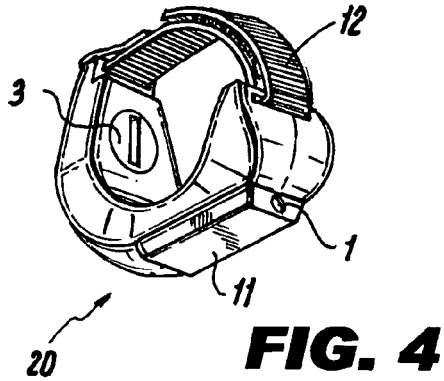
FIG. 4 is a perspective view of the assembled device of FIG. 3.
Figure 5:
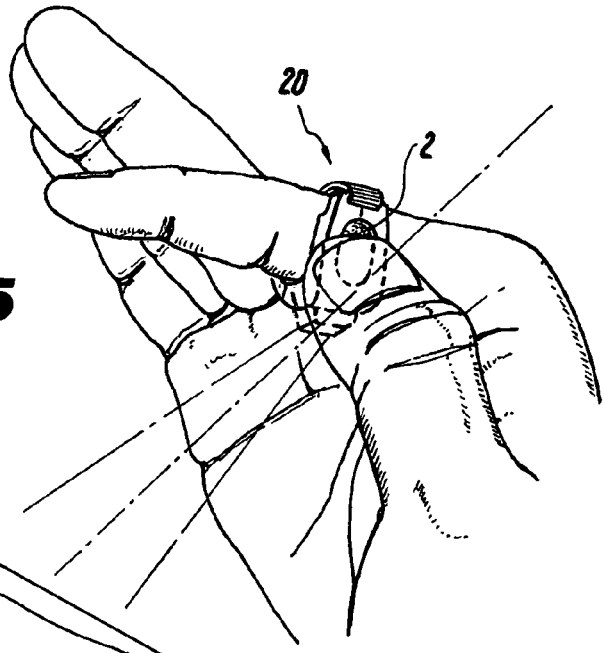
FIG. 5 is a magnified view of area 5 of FIG. 1. The device's control switch is shown be actuated by the wearer's thumb. The device can also be configured to place the control switch on the finger side of the device.
Figure 6:
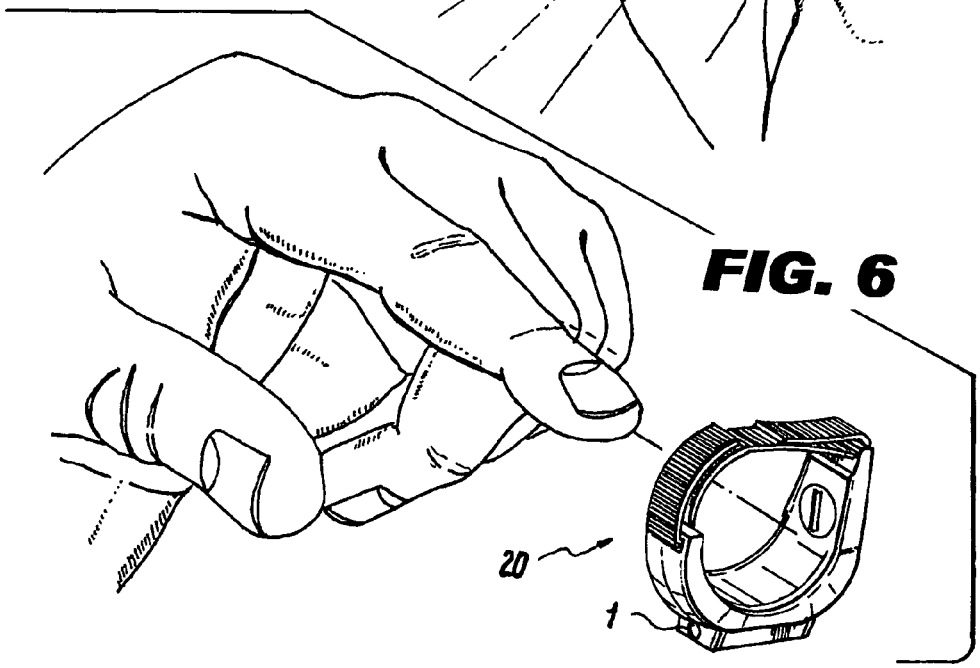
FIG. 6 depicts the placement of the device on the ring finger of the wearer. The device in the present figure utilizes an adjustable strap to allow the device to be worn on fingers of various sizes and also features a finger side activation switch with the LED on the thumb side of the device.
Figure 7:
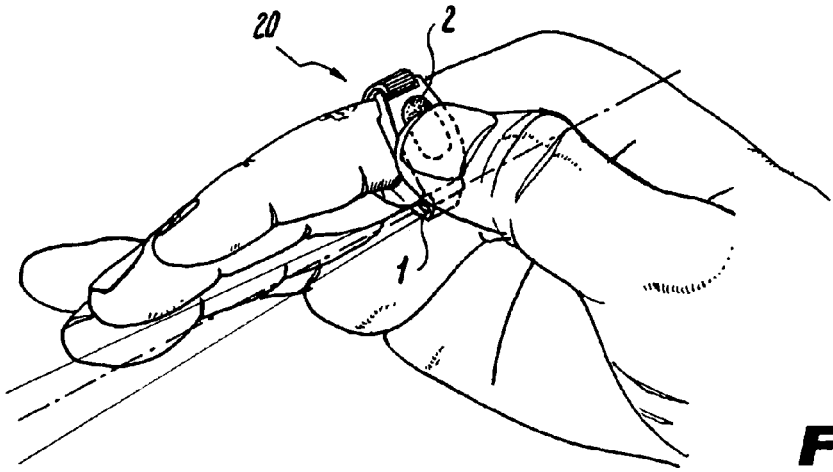
FIG. 7 depicts the method of using the hand of the wearer to direct the light emitted by the device.

Referring to FIGS. 3 and 4, the battery compartment cover 3 is shown to contain a key slot 13, which allows the battery compartment cover 3 to be rotated by an inserted coin, screwdriver, fitted key, or similarly edged implement and subsequently removed from the battery compartment 10 of the ring 20 so that the battery 6 can be replaced. It is anticipated that the battery 6 could be either rechargeable or replaceable.

Figure 8:
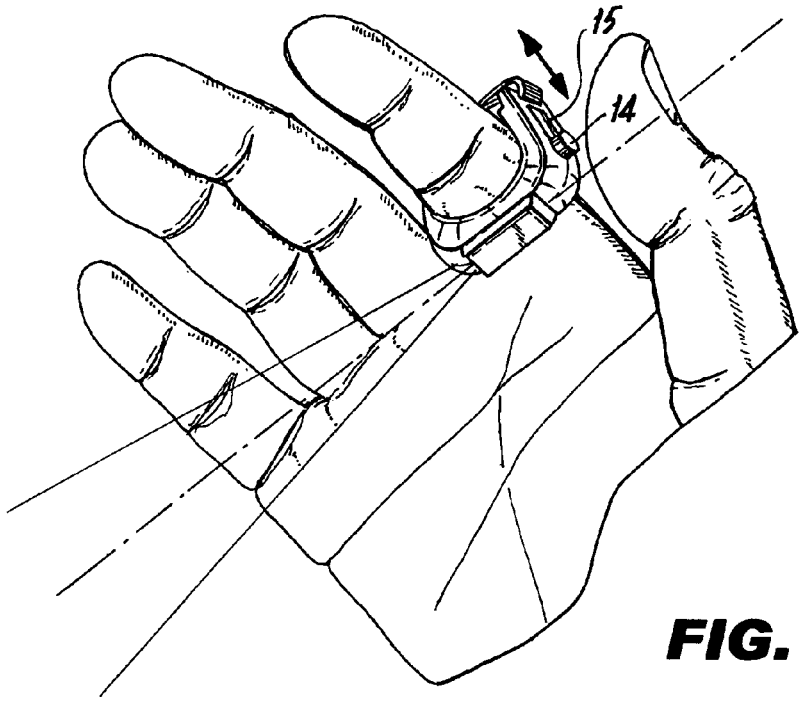
FIG. 8 is a perspective view of an alternative embodiment utilizing an thumb-side switch and sliding intensity control in conjunction with a panel covering the LED light source.
Figure 14:
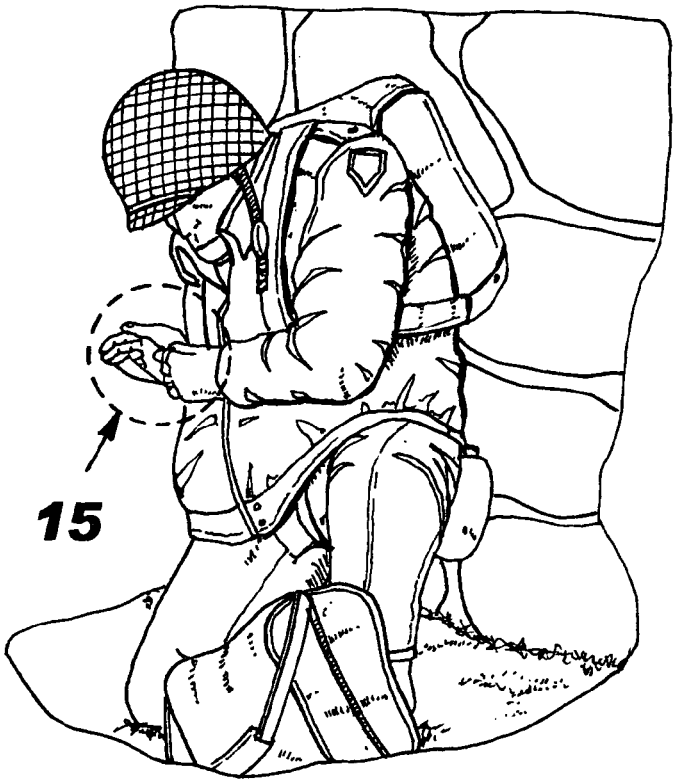
FIG. 14 depicts an anticipated application of the device used in a military operation.
Figure 15:
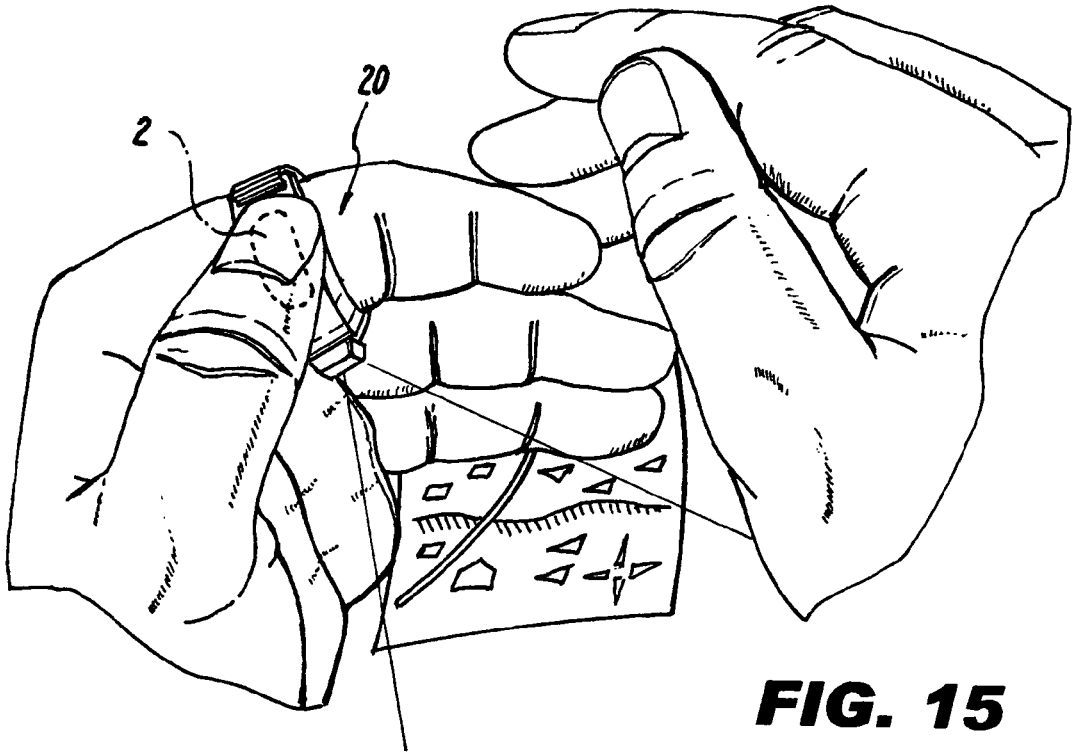
FIG. 15 is a magnified view of area 15 of FIG. 14. Depicted is the use of the device to illuminate a map and the method of shielding the light emitted from the device by cupping the hands.

Referring to FIG. 8, the bottom of the LED housing 11 could be replaced by a panel 16 to either focus or diffuse the light rather than have the LED 1 protrude from the LED housing 11. A further embodiment depicts the substitution of a control switch 14 with a slide path 15 for the control switch 14 to vary the intensity of the beam.

FIG. 9 depicts the device 20 with a lens 17 to focus the beam of light from the LED 1.

FIG. 10 depicts the device 20 with a solid arch 18, in place of the adjustable strap 12, to complete the finger orifice 7.

What is claimed is:

1. An illuminating device comprising, at least one battery powered LED integrated with a finger worn ring possessing an interior surface and an exterior surface having a palm side, an inner side facing the thumb of the ring bearing hand when worn, an outer side facing away from the thumb of the ring bearing hand when worn, a top side, an LED housing, a pressure sensitive power control switch and an electromechanical control means to adjust the intensity of the illumination; wherein said LED housing is affixed on the palm side of said ring and configured to direct light downward at an angle generally bisecting said palm side and said inner side of said ring, said LED Housing and said LED having a light having a profile that does not substantially interfere with the ability of the wearer to close the ring bearing hand and said top side having a profile no thicker than said base side.

2. The device of claim 1, wherein said battery is rechargeable.

3. The device of claim 1, wherein the body of said ring is annular.

4. The device of claim 1, wherein the body of said ring is partially annular.

5. The device of claim 1, wherein said ring possesses an adjustable strap.

6. The device of claim 1, wherein said at least one LED emits different wavelengths of light when more than one LED is present on the device.

7. The device of claim 1, wherein said at least one LED emits light through at least one light filter.

8. The device of claim 1, wherein said at least one LED emits a wavelength of visible light within the blue to green spectrum.

9. The device of claim 1, wherein said at least one LED emits a wavelength of visible light within the red spectrum.

10. The device of claim 1 wherein said power control switch is embedded in the side of said ring and may be actuated by lateral compression of an adjacent finger against said power control switch.

11. The device of claim 1 wherein said electromechanical control means for adjusting the intensity of said emitted light is a slide mechanism.

12. The device of claim 1 wherein said electromechanical control means for adjusting the intensity of said emitted light is a mechanism to allow the user to click through several settings.

13. The device of claim 1, wherein said ring is encased by a waterproof covering.

14. The device of claim 13, wherein said waterproof covering is comprised of the group consisting of natural rubber, synthetic rubber, silicone based polymers, and organic polymers.

15. The device of claim 1, wherein said device is designed to be shock resistant.

16. The device of claim 1, wherein said ring is comprised of materials consisting of wood, metal, plastic, or synthetic composites.

17. The device of claim 1, wherein said electromechanical control means is configured to vary the intensity of the illumination by controllably applying pressure to a electromechanical control mechanism on said ring so as to adjust the intensity of the provided illumination between none to maximum and at least one level between none and maximum.

* * * * *